US006661329B1

(12) United States Patent
Gibson

(10) Patent No.: US 6,661,329 B1
(45) Date of Patent: Dec. 9, 2003

(54) ADJUSTABLE THERMAL TRIP ASSEMBLY FOR A CIRCUIT BREAKER

(75) Inventor: Jeffrey S. Gibson, Hookstown, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/170,890

(22) Filed: Jun. 13, 2002

(51) Int. Cl.[7] ..... H01H 71/74; H01H 71/16

(52) U.S. Cl. ..... 337/84; 337/82; 337/57; 337/13; 335/45; 335/35

(58) Field of Search ..... 337/36, 37, 57, 337/59, 13, 82, 84; 335/8–10, 21–25, 35–37, 43, 45, 172, 173

(56) References Cited

U.S. PATENT DOCUMENTS

| | | | | | |
|---|---|---|---|---|---|
| 3,015,007 | A | * | 12/1961 | Howard | 337/56 |
| 3,038,051 | A | * | 6/1962 | Howard | 337/62 |
| 3,183,328 | A | * | 5/1965 | Wheeler | 337/56 |
| 3,251,966 | A | * | 5/1966 | Kussy et al. | 337/45 |
| 3,423,712 | A | * | 1/1969 | Howard | 337/77 |
| 4,603,312 | A | * | 7/1986 | Conner | 335/42 |
| 4,635,020 | A | * | 1/1987 | Sako | 337/49 |
| 4,652,847 | A | * | 3/1987 | Sako | 337/49 |
| 4,763,096 | A | * | 8/1988 | Ingrain | 337/82 |
| 4,785,274 | A | * | 11/1988 | Sako et al. | 337/49 |
| 4,808,961 | A | * | 2/1989 | Sako et al. | 337/49 |
| 4,922,220 | A | | 5/1990 | Livesey et al. | |
| 4,973,928 | A | | 11/1990 | Grunert | |
| 4,983,939 | A | * | 1/1991 | Shea et al. | 335/42 |
| 5,831,501 | A | | 11/1998 | Kolberg et al. | |
| 5,894,259 | A | | 4/1999 | Kolberg et al. | |
| 6,445,274 | B1 | * | 9/2002 | Malingowski et al. | 337/49 |

* cited by examiner

*Primary Examiner*—Anatoly Vortman
(74) *Attorney, Agent, or Firm*—Martin J. Moran

(57) ABSTRACT

The circuit breaker current/time characteristic value at which the bimetal in a thermal trip assembly actuates a trip mechanism is adjusted by an adjustable coupler that includes first and second pivoted members separately rotatable about a common pivot axis. Deflection of the bimetal by an overload current causes rotation of the first pivoted member, which is coupled by a coupling member extending parallel to the common axis into the second pivoted member which rotates to actuate the trip mechanism. A positioner moves the coupling member toward and away from the common pivot axis to adjust the amount of deflection of the bimetal needed to actuate the trip mechanism.

9 Claims, 3 Drawing Sheets

ADJUSTABLE THERMAL TRIP ASSEMBLY FOR A CIRCUIT BREAKER

BACKGROUND OF THE INVENTION

1. Field of the Invention

This invention relates to circuit breakers with a thermal trip assembly, and more particularly to an arrangement for adjustment of the current/time characteristic value at which the assembly responds.

2. Background Information

It is common in the small circuit breakers used for residential and light commercial or industrial applications to utilize a bimetal to provide a delayed trip in response to persistent overload conditions. The heat generated by the overload condition causes the bimetal to deflect until it actuates a trip mechanism to interrupt the current. Thus, it is also known as a thermal trip. In some applications, it is desirable to allow the user to adjust the thermal trip function. Thus, it is known, for instance, to provide a slide which adjusts a gap between the deflecting bimetal and the trip mechanism. Such an arrangement is not always possible, as where the available location for the adjustment mechanism is substantially spaced from the bimetal within the molded housing of the circuit breaker.

There is need, therefore, for an improved adjustable thermal trip assembly for circuit breakers.

SUMMARY OF THE INVENTION

This need and others are: satisfied by the invention, which is directed to an adjustable thermal trip assembly for a circuit breaker comprising a coupler that is adjustable to select the overload current/time characteristic value at which deflection of the free end of a bimetal actuates the trip mechanism of the circuit breaker. This adjustable coupler includes a first pivoted member, a second pivoted member and a coupling member adjustably positioned between the first and second pivoted members to convert pivoting of the first pivoted member by the free end of the bimetal into rotation of the second pivotal member to actuate the trip mechanism after a selected deflection of the free end of the bimetal and therefore in response to a selected current/time characteristic value. The first and second pivoted members can be pivoted about parallel pivot axes with the adjustable coupler including a positioner moving the coupling member selectively toward and away from the parallel pivot axes of the first and second pivot members. The parallel pivot axes of the first and second pivot members can comprise a common pivot axis with the first and second pivot members axially spaced along this common pivot axis. In this case, the coupling member extends axially parallel to the common pivot axis.

The positioner can comprise a rotatable member rotatable about a positioner axis parallel to but laterally displaced from the common pivot axis. In this case, the coupling member can have a mounting arm eccentrically engaging the rotatable member, whereby rotation of the rotatable member effects the movement of the coupling member toward and away from the common pivot axis of the first and second pivot members. This rotatable member can comprise a driven bevel gear in which case the positioner further includes a driving bevel gear meshing with the driven bevel gear and an adjustment knob coupled to the driving bevel gear. The adjustment knob can have an indexer setting discrete rotatable positions of the driving bevel gear and therefore the discrete current/time characteristic values at which the trip mechanism is actuated.

The invention is applicable to single-pole and multipole circuit breakers. In the latter case, where each of the plurality of poles has a bimetal, a first pivoted member mounted on the common pivot axis is associated with each bimetal and the coupling member couples the selected rotation of any of the first pivoted members by the associated bimetal into rotation of the second pivoted member, and therefore actuation of the trip mechanism at the selected current/time characteristic value.

In another embodiment of the invention adapted for use with a multipole circuit breaker each pole has an adjustable coupler with the rotatable member of the positioner of the adjustable coupler of all of the poles mounted on a common shaft rotatable about the positioner axis parallel to but laterally displaced from the common pivot axis. In this arrangement, the rotating member of the positioner of one of the poles can be a driven bevel gear which is engaged by a driving bevel gear that is rotated by an adjustment knob to effect rotation, and therefore, simultaneous adjustment of the current/time characteristic value at which the trip mechanism of each pole is actuated.

BRIEF DESCRIPTION OF THE DRAWINGS

A full understanding of the invention can be gained from the following description of the preferred embodiments when read in conjunction with the accompanying drawings in which.

DESCRIPTION OF THE:PREFERRED EMBODIMENTS

Figure 1:
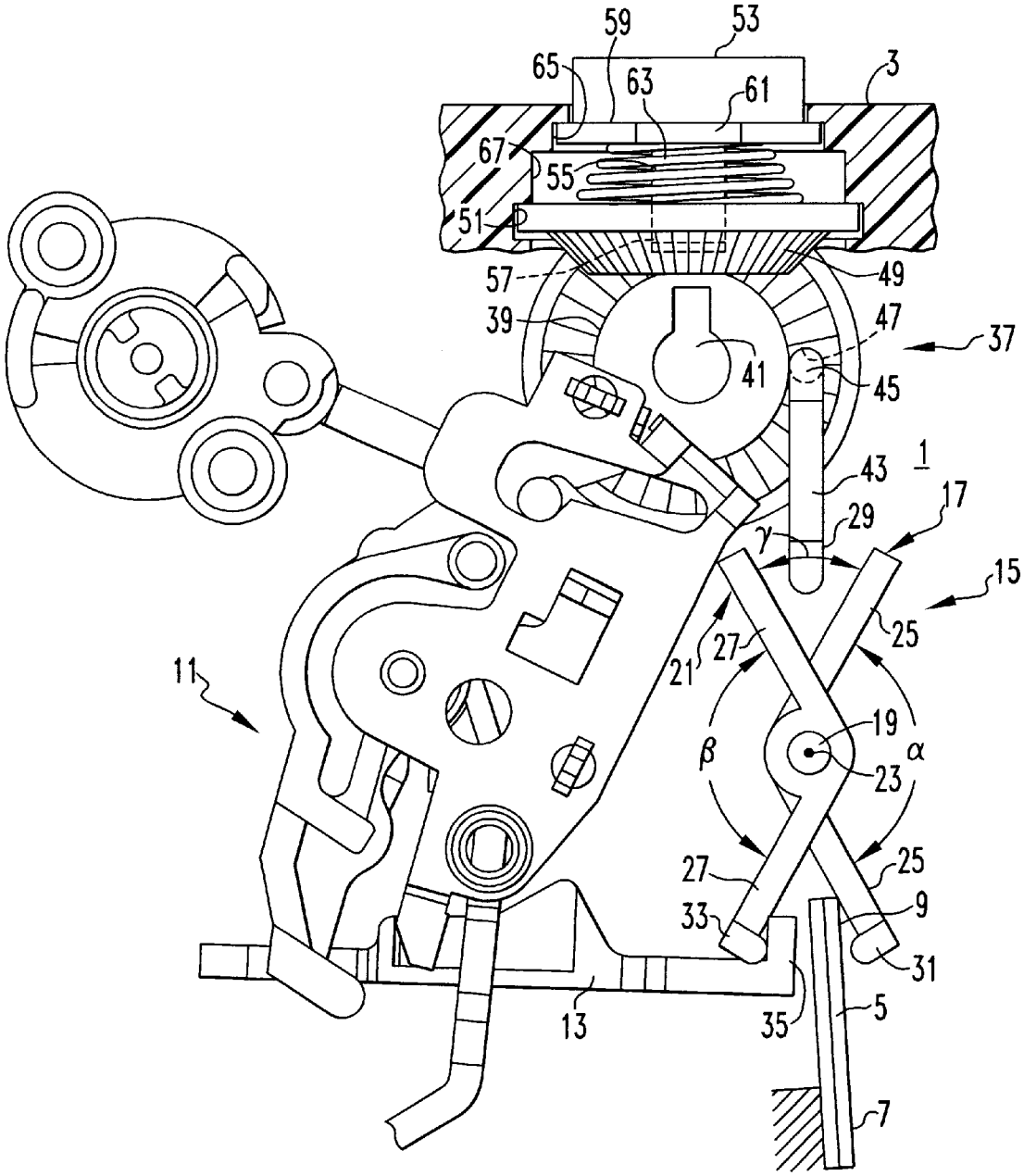
FIG. 1 is an elevation view of an adjustable thermal trip assembly for a circuit breaker in accordance with the invention.

FIG. 1 illustrates an adjustable thermal trip assembly 1 of the invention mounted in the partially shown molded casing 3 of a circuit breaker. The adjustable thermal trip assembly 1 includes a bimetal 5 having a fixed end 7 and a free end 9. As is well known in the art, current in the circuit being protected by the circuit breaker is either passed through the bimetal 5 or through a heater adjacent the bimetal 5. In either case, the bimetal is heated by the load current, which in effect, provides an integration of the load current over time. This heating of the bimetal 5 causes the free end 7 to deflect, to the right as viewed in FIG. 1.

The adjustable thermal trip assembly 1 also includes a trip mechanism 11 which in this case has a trip bar 13. In this known type of trip mechanism 11, the free end 9 of the bimetal 5 couples directly to the trip bar 13 to actuate the trip mechanism 11 when the current/time characteristics of the load current is at a specified value. It is an object of the present invention to make the value of this current/time characteristic at which the trip mechanism 11 actuates adjustable, especially where the bimetal 5 and trip bar 13 are located in the circuit breaker at a distance from where an adjustment mechanism accessible from outside of the molded housing can be located. Thus, the invention includes an adjustable coupler 15 between the free end 9 of the bimetal 5 and the trip bar 13 of the trip mechanism 11. This adjustable coupler 15 includes a first pivoted member 17 rotatably mounted on a shaft 19. A second pivoted member 21 is mounted for separate rotation upon the shaft 19 which forms a common pivot axis 23 for the two pivoted members 17 and 21. The pivoted members 17 and 21 each have a pair of arms 25 and 27 which form obtuse angles $\alpha$ and $\beta$, respectively, such that the arms of each of the pivoted members remains on the same side of the vertical as seen in FIG. 1.

Figure 2:
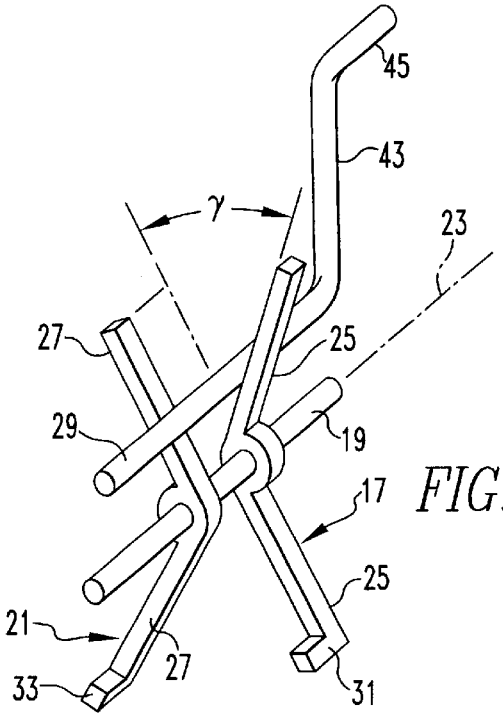
FIG. 2 is an isometric view of a portion of the assembly shown in FIG. 1.

The adjustable coupler 15 also includes a coupling member 29. As can be appreciated by reference also to FIG. 2, this coupling member 29 extends axially parallel to but offset laterally from the common pivot axis 23 within the angle $\gamma$ formed by the upper arms 25 and 27 of the pivoted members 17 and 21. With this arrangement, when the bimetal 5 detects a persistent overload condition and the free end 9 deflects clockwise in FIG. 1, it engages a foot 31 on the lower arm 25 and rotates the first pivoted member 17 in the counterclockwise direction as seen in FIG. 1. This brings the upper arm 25 of the pivoted member 17 into contact with the coupling member 29 which is carried with the pivoted member 17 counterclockwise until it contacts the upper arm 27 to in turn rotate the second pivoted member 21 counterclockwise. A foot 33 on the lower arm 27 of the second pivoted member 21 engages a hook 35 on the trip bar 13, thereby pulling the trip bar to the right and actuating the trip mechanism 11.

The adjustable coupler 15 further includes a positioner 37 which 23 moves the coupling member 29 toward and away from the common pivot axis within the angle y between the upper arms 25 and 27 of the first and second pivoted members 17 and 21. As the lateral distance between these arms increases with distance from the common pivot axis 23, it can be appreciated that increased deflection of the free end 9 of the bimetal 5 is required to actuate the trip mechanism as the coupling member 29 is moved further from the common pivot axis 23. Thus, the current/time characteristic value at which the trip mechanism is actuated can be selectively varied by raising and lowering the coupling member 29.

The positioner 37 includes a rotatable member in the form of a first bevel gear 39 which is mounted for rotation on a positioner shaft 41 which is parallel to but laterally separated from the common pivot axis 23. The coupling member 29 has a mounting arm 43 having a terminal section 45 which is parallel to the coupling member 29. This terminal section 45 of the mounting arm is rotatably received in an opening 47 in the bevel gear 39 which is eccentric to the gear shaft 41. Thus, rotation of the first bevel gear in the clockwise direction moves the coupling member 29 toward the common axis 23 to reduce the amount of bimetal deflection, and therefore lowers the current/time characteristic value, required to actuate the trip mechanism. Conversely, counterclockwise rotation of the first bevel gear 39 raises the coupling member 29 and increases the current/time characteristic value for trip mechanism actuation.

Figure 3:
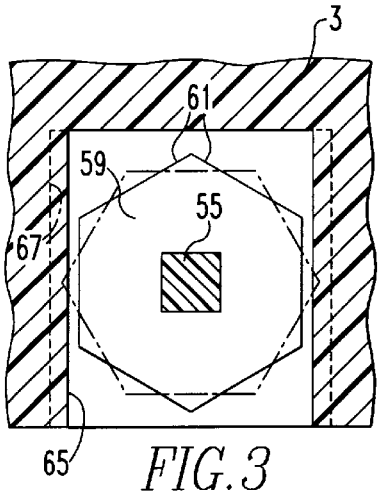
FIG. 3 is a fragmentary horizontal section through a portion of the circuit breaker casing.

The positioner 37 further includes a driving bevel gear 49 which meshes with the first or driven bevel gear 39 and is mounted for rotation about a vertical axis in a slot 51 in the molded casing 3. An adjustment knob 53 has a shaft 55 which is keyed to and is axially slidable within a bore 57 in the driving bevel gear 49. An indexer 59 on the adjustment knob 53 has a number of peripheral flats 61. A locking spring 63 bearing against the driving bevel gear 49 biases the indexer 59 upward toward a slot 65. However, as shown in FIG. 3, the slot 65 is sized such that the indexer 59 can only enter the slot 65 when the flats 61 are aligned with the sides of the slot 65. This locks the adjustment knob 53 and, in turn, the position of the coupling member 29 relative to the common axis 23 in one of a plurality of discrete positions. In order to select between these discrete positions, the adjustment knob 53 is pushed downward against the bias of the locking spring 63 until the indexer 59 is aligned with a wider slot 67 in which it can be rotated between the discrete positions, as shown in phantom in FIG. 3. When the indexer is aligned with another discrete position, release of the adjustment knob 53 allows the locking spring 63 to seat the indexer in the slot 65.

Figure 4:
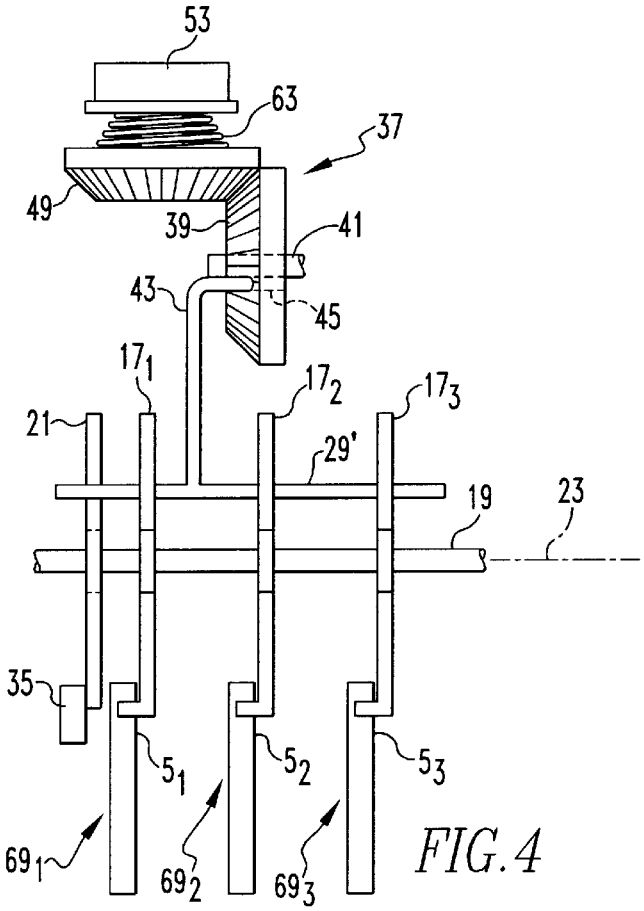
FIG. 4 is a side elevation view of a multipole embodiment of the invention.

The adjustable thermal trip assembly 1 of the invention can be applied to multipole circuit breakers as shown in FIG. 4. This circuit breaker has three poles $\mathbf{69}_1$–$\mathbf{69}_3$, each with a bimetal $\mathbf{5}_1$–$\mathbf{5}_3$. In this arrangement, a separate first pivoted member $\mathbf{17}_1$–$\mathbf{17}_3$ associated with one of the three bimetals $\mathbf{5}_1$–$\mathbf{5}_3$, respectively, is separately pivotally mounted on the shaft 19 for rotation about the common axis 23. A single second pivoted member 21 is also mounted on the shaft 19 for rotation about the common pivot axis 23. The coupling member 29' is lengthened so that it is engageable by each of the first pivoted members $\mathbf{17}_1$–$\mathbf{17}_3$ and also engages the single second pivoted member 21. Thus, an overload in any one of the poles will rotate the associated first pivot member $\mathbf{17}_1$–$\mathbf{17}_3$ to engage the coupling member 29', which couples the bimetal deflection to rotation of the single second pivoted member 21 to actuate the trip mechanism. A common positioner 37 adjusts the current/time characteristic value for actuation of the trip mechanism for all three poles simultaneously by raising and lowering the coupling member 29'.

Figure 5:
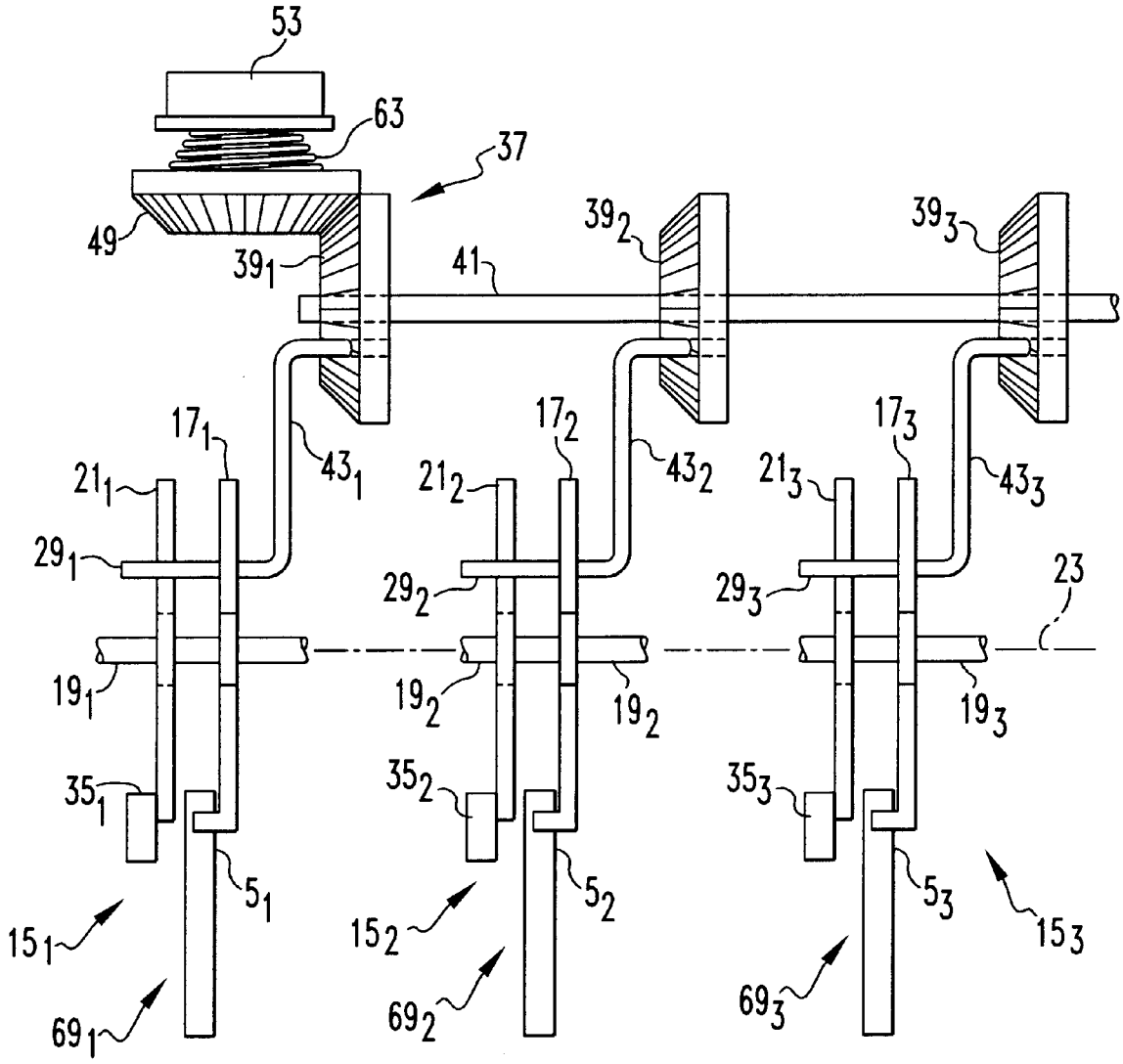
FIG. 5 is a side elevation view of another multipole embodiment of the invention.

FIG. 5 illustrates another multipole embodiment of the invention. Each pole $\mathbf{69}_1$, $\mathbf{69}_2$ and $\mathbf{69}_3$ has its own adjustable coupler $\mathbf{15}_1$, $\mathbf{15}_2$ and $\mathbf{15}_3$. Each of these adjustable couplers $\mathbf{15}_1$, $\mathbf{15}_2$ and $\mathbf{15}_3$ has its own first pivoted member $\mathbf{17}_1$, $\mathbf{17}_2$, and $\mathbf{17}_3$, and its own second pivoted member $\mathbf{21}_1$, $\mathbf{21}_2$ and $\mathbf{21}_3$ mounted on a common shaft $\mathbf{19}_1$, $\mathbf{19}_2$ and $\mathbf{19}_3$. Each also has its own coupling member $\mathbf{29}_1$, $\mathbf{29}_2$ and $\mathbf{29}_3$ with a mounting arm $\mathbf{41}_1$, $\mathbf{41}_2$ and $\mathbf{41}_3$ eccentrically mounted on a rotating member $\mathbf{39}_1$, $\mathbf{39}_2$ and $\mathbf{39}_3$. The rotating members $\mathbf{39}_1$, $\mathbf{39}_2$ and $\mathbf{39}_3$ are all mounted for simultaneous rotation on common positioner shaft 41 which is parallel to but also laterally spaced from the shafts $\mathbf{19}_1$, $\mathbf{19}_2$ and $\mathbf{19}_3$. One of the rotating members, for instance, $\mathbf{39}_1$ is a driven bevel gear which meshes with the driving bevel gear 49. As described in connection with FIG. 1, the driving bevel gear 49 can be rotated by the adjustment knob 53. The rotating members $\mathbf{39}_2$ and $\mathbf{39}_3$ do not have to be bevel gears, although the number of different parts is reduced when they are bevel gears as shown in FIG. 5. With the arrangement of FIG. 5, rotation of the adjustment knob 53, effects adjustment of the positions of the coupling members $\mathbf{29}_1$, $\mathbf{29}_2$ and $\mathbf{29}_3$ to adjust the current/time characteristics at which the trip mechanism for each of the poles is actuated.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An adjustable thermal trip assembly for a circuit breaker comprising:

a bimetal having a fixed end and a free end which deflects in response to heat generated by current;

a trip mechanism spaced from the free end of the bimetal; and an adjustable coupler comprising:

a first pivoted member engageable by the free end of the bimetal for rotation by deflection of the free end of the bimetal;

a second pivoted member rotatable to actuate the trip mechanism;

a coupling member positioned between the first and second pivotable members to convert rotation of the first pivotable member by the free end of the bimetal into rotation of the second pivoted member to actuate the trip mechanism after a selected deflection of the free end of the bimetal; and a positioner adjustably positioning the coupling member relative to the first and second pivoted members to adjust a current/time characteristic value at which the trip mechanism is actuated.

2. The adjustable thermal trip assembly of claim 1 in which the first and second pivoted members are pivoted about parallel pivot axes and the positioner selectively positions the coupling member toward and away from the parallel pivot axes of the first and second pivoted members.

3. The adjustable thermal trip assembly of claim 2, wherein the parallel pivot axes comprise a common pivot axis about which the first and second pivoted members rotate in axially spaced relation, and the coupling member extends axially substantially parallel to the common pivot axis.

4. The adjustable thermal trip assembly of claim 3, wherein the positioner comprises a rotatable member rotatable about a positioner axis parallel to but laterally displaced from the common pivot axis and the coupling member has a mounting arm eccentrically engaging the rotatable member.

5. The adjustable thermal trip assembly of claim 4, wherein the rotatable member comprises a driven bevel gear and the positioner further includes a driving bevel gear meshing with the driven bevel gear, and an adjustment knob coupled to the driving bevel gear for manual rotation of the driving gear.

6. The adjustable thermal trip assembly of claim 5, wherein the adjustment knob has an indexer setting discrete rotational positions of the driving bevel gear and therefore discrete current/time characteristic values at which the trip mechanism is actuated.

7. The adjustable thermal trip assembly of claim 4 adapted for use with a multipole circuit breaker having a bimetal and a trip mechanism associated with each pole, wherein each pole has an adjustable coupler with the rotatable members of all of the poles mounted on a common positioner shaft for adjusting the lateral position relative to the common axis of the coupling member coupling the first pivoted member and a second pivoted member of each pole.

8. The adjustable thermal trip assembly of claim 7 wherein the rotatable member of at least one of the poles comprises a driven bevel gear mounted on the common positioner shaft, a driving bevel gear meshing with the driven bevel gear and an adjustment knob coupled to the driving bevel gear for manual rotation of the driving bevel gear, and therefore, the rotating member of each pole through rotation of the common positioner shaft.

9. The adjustable thermal trip assembly of claim 3 adapted for use with a multipole circuit breaker having a plurality of bimetals wherein a first pivoted member mounted on the common pivot axis is associated with each bimetal and the coupling member couples the selected rotation of any of the first pivoted members by the associated bimetal into rotation of the second pivoted member and therefore actuation of the trip mechanism: at the selected current/time characteristic value.

* * * * *